US006966071B1

(12) United States Patent
Cascone

(10) Patent No.: US 6,966,071 B1
(45) Date of Patent: Nov. 22, 2005

(54) ADJUSTABLE AND REVERSIBLE BASEBALL CAP

(76) Inventor: Craig Cascone, 11452 Monument Ridge Dr., Jacksonville, FL (US) 32225

( * ) Notice: Subject to any disclaimer, the term of this patent is extended or adjusted under 35 U.S.C. 154(b) by 0 days.

(21) Appl. No.: 10/667,211

(22) Filed: Sep. 18, 2003

Related U.S. Application Data

(60) Provisional application No. 60/412,143, filed on Sep. 19, 2002.

(51) Int. Cl.[7] ..... A42B 1/22
(52) U.S. Cl. ..... 2/195.2
(58) Field of Search ..... 2/195.1, 195.2; D2/881

(56) References Cited

U.S. PATENT DOCUMENTS

| | | | | |
|---|---|---|---|---|
| 4,612,672 A | | 9/1986 | Schrack | |
| 4,768,231 A | | 9/1988 | Schrack | |
| 5,046,193 A | | 9/1991 | Foresman et al. | |
| 5,091,995 A | | 3/1992 | Oates | |
| 5,181,277 A | * | 1/1993 | Sherman | 2/181.4 |
| D365,917 S | * | 1/1996 | Armstrong | D2/881 |
| 5,553,321 A | | 9/1996 | Cassel | |
| 5,724,678 A | * | 3/1998 | McCallum et al. | 2/209.13 |
| 5,765,229 A | | 6/1998 | McLeod et al. | |
| 6,076,192 A | | 6/2000 | Kronenberger | |
| 6,374,423 B1 | | 4/2002 | Anderson et al. | |

* cited by examiner

*Primary Examiner*—John J. Calvert
*Assistant Examiner*—Brian Kauffman
(74) *Attorney, Agent, or Firm*—Garvey, Smith, Nehrbass & Doody, L.L.C.; Charles C. Garvey, Jr.

(57) ABSTRACT

A reversible baseball style cap provides a crown having first and second layers of material that together form a dome shape that enables a user to wear and conform the crown to the user's head, and wherein either layer can be shaped into a concavity that abuts the user's head during use and wherein the outer layer defines an outer exposed surface. A bill of a floating foam material has a first curved edge that is stitched to the crown in between the first and second layers. The bill has a second curved edge defining a front of the cap. An adjustment cord extends through an opening in at least one of the layers at a position opposite the bill. The cord has end portions that are attached to the crown at two positions generally on opposite sides of the cord opening. A sleeve adjustably, slidably attaches to the cord to form an adjustable loop with the cord. A user can adjust the fit of the hat to his or her head by moving the cord relative to the sleeve so that when the loop is enlarged or reduced in size, the cap can be fitted to the wearer when either the first or second layer is the outer exposed surface. In the preferred embodiment, the brim is of a different material than the crown, preferably a floating material that has sufficient floatation to float the entire cap, even when the crown portion is saturated with water.

8 Claims, 3 Drawing Sheets

ADJUSTABLE AND REVERSIBLE BASEBALL CAP

CROSS-REFERENCE TO RELATED APPLICATIONS

Priority of U.S. Provisional Patent Application Ser. No. 60/412,143, filed Sep. 19, 2002, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to baseball style caps, and more particularly to a reversible, floating baseball style cap with a brim or bill that easily folds when subjected to high winds ensuring that it will not be removed from a wearer's head, such as when boating.

2. General Background of the Invention

Baseball caps are frequently used by boaters for protection from the sun on bright sunny days. However, one of the most common problems with a standard baseball style cap is that of loss due to wind as the boater travels the waterways at speeds of typically between about 25 and 50 mph.

Baseball caps have a rigid brim that functions as a sail when exposed to high winds. In such a situation, the brim is commonly pulled and blown backward removing the entire hat from the wearer's head.

Several patents have issued that are directed to various cap constructions, some being specifically directed to boating or to sports that can be very active, sometimes causing the hat to separate from the user's head.

PRIOR ART PATENTS

| U.S. PAT. NO. | Title | Issue Date |
|---|---|---|
| 4,612,672 | Protective Head Gear | Sep. 23, 1986 |
| 4,768,231 | Protective Headgear | Sep. 06, 1988 |
| 5,046,193 | Aquatic Thermal Head Covering | Sep. 10, 1991 |
| 5,091,995 | Sports Cap | Mar. 03, 1992 |
| 5,553,321 | Eyeglasses Visor and Case | Sep. 10, 1996 |
| 5,765,229 | Sun Visor Cap Headgear for Use During Water Activities | Jun. 16, 1998 |
| 6,076,192 | Headwear Piece With Projecting Bill | Jun. 20, 2000 |
| 6,374,423 | Sports Helmet With Full Flexible Brim | Apr. 23, 2002 |

In the above list of patents, the McLeod et al. U.S. Pat. No. 5,765,229 is directed to a cap or hat that is said to be useful for cycling, kayaking or white water rafting. In the McLeod patent, the front bill is said to be compliant enough to eliminate the problem of hydrodynamic drag.

BRIEF SUMMARY OF THE INVENTION

The present invention provides an improved baseball style reversible cap. The apparatus includes a neoprene bill that flips up when you are in motion, such as when traveling in a boat, allowing the hat to remain on your head. The bill is of a neoprene or closed cell foam material that floats and is of a size and shape so that the bill buoys up the entire hat if it falls into the water.

The apparatus of the present invention provides an improved baseball style reversible cap that is washable, unlike many hats.

The present invention provides a baseball style reversible cap with a neoprene bill that absorbs perspiration.

The apparatus of the present invention provides an improved baseball style reversible cap having an easy to use adjustment cord that enables adjustability of the hat to a user's head in either of the two reversible wearing positions. The apparatus of the present invention thus provides an improved, comfortable reversible baseball style cap. The apparatus includes a crown (e.g. cotton, Supplex, or the like) having a first layer and a second layer with a domed shape that enables a user to wear and conform the crown to the user's head. The two layers are preferably fabric.

A feature of the present invention is that either layer can be shaped into a concavity that abuts a user's head during use and wherein the other layer defines an outer exposed surface.

A brim or bill is preferably of a material that floats. More particularly, the brim is of a floating foam material such as a closed cell foam or neoprene that has a first curved edge that is stitched to the crown in between the first and second layers. The bill has a second curved edge that defines a front of the cap. The brim is of sufficient size and shape that the brim alone supplies floatation sufficient to float the entire cap article.

An adjustment cord extends through an opening in one of the layers at a position opposite the brim or bill, the cord having end portions that are attached to the crown in between the first and second layers and at two positions generally on opposite sides of the cord opening.

A sleeve adjustably and slidably attaches to the cord to form an adjustable loop with the cord.

With the improved reversible baseball style cap of the present invention, a user can adjust the fit of the hat to his or her head by moving the cord relative the sleeve so that the loop is enlarged or reduced in size and with either of the first or second layers formed in a concavity to abut the user's head.

In summary, the cord can be adjusted to fit the crown to a user's head in either of the two reversible positions of the cap. Because the hat does not use a brim with paper reinforcement, the entire cap article can be immersed in water, (or ice water) soaked and then placed back on the user's head. This feature helps cool a user during hotter times of the year or in hot climates.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
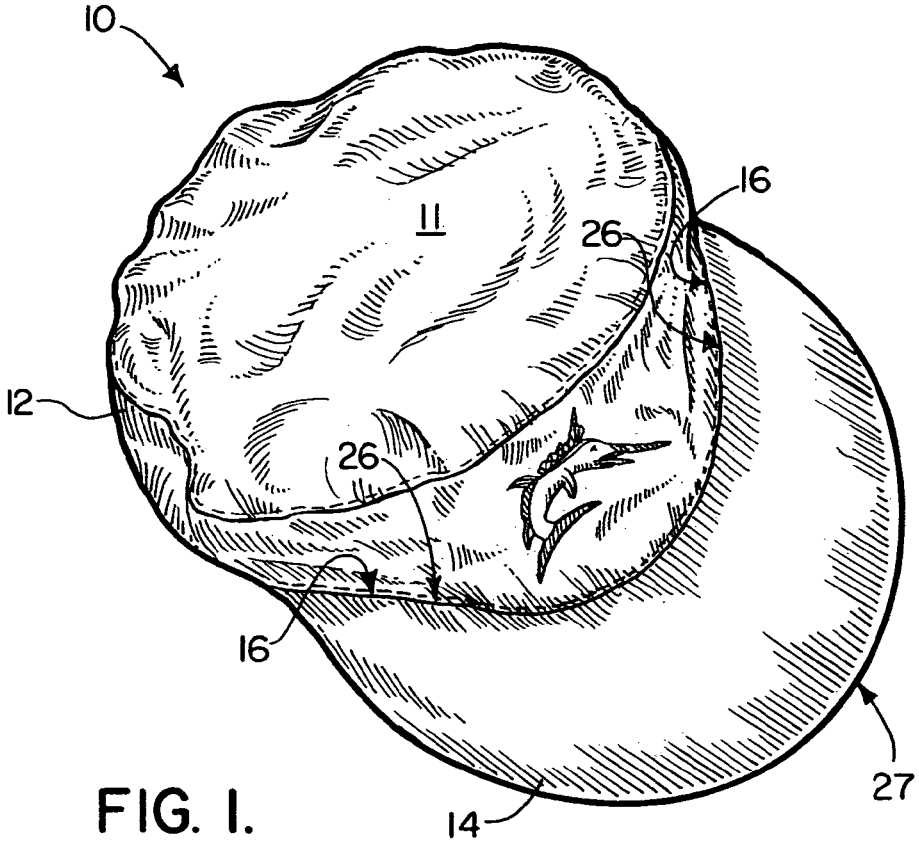
FIG. 1 is a perspective, top view of the preferred embodiment of the apparatus of the present invention showing the cap in a first position that exposes the first layer of the crown.

The present invention provides an improved baseball style reversible cap article 10 that is particularly suited for use in high speed sports and like activities such as fishing or boating. The cap article 10 of the present invention provides a crown 11 that is comprised of a pair of layers, including a first layer 12 and a second layer 13.

A brim 14 of neoprene or other like floating material such as a closed cell foam, for example, is sandwiched between the first layer 12 and the second layer 13 at stitching 15, 16. The brim 14 has a first curved edge portion 26 that is stitched to the first and second layers 12, 13 at stitching 15, 16. The brim has a second curved edge 27 that defines the front part of the cap 10.

Figure 2:
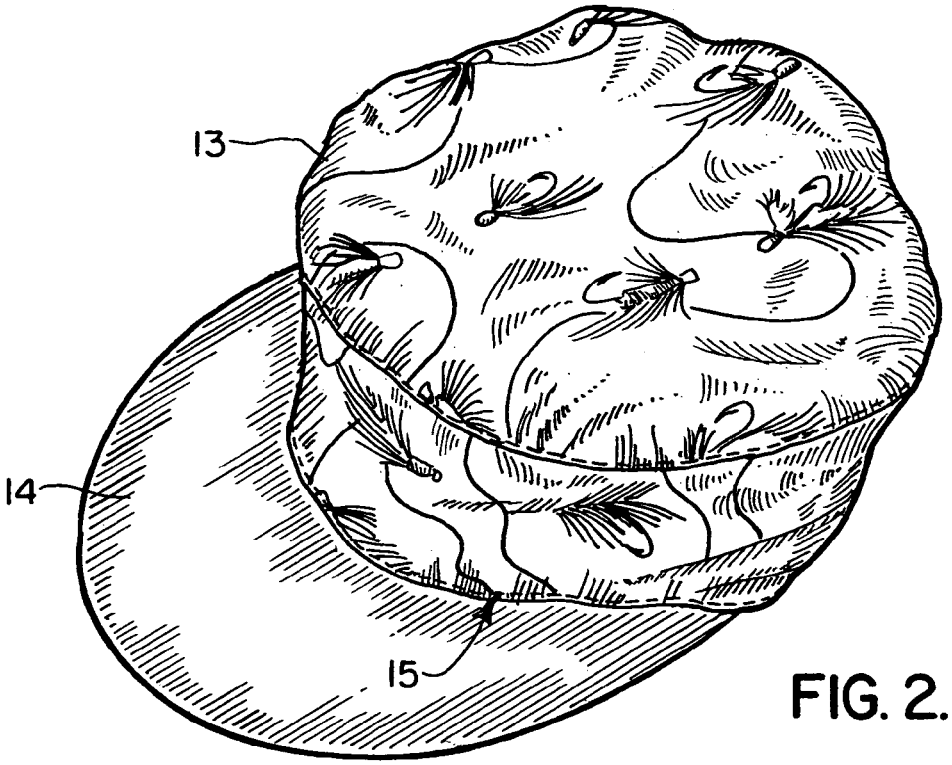
FIG. 2 is a perspective view of the preferred embodiment of the apparatus of the present invention showing the cap with the second layer as an exposed outer surface of the crown.
Figure 3:
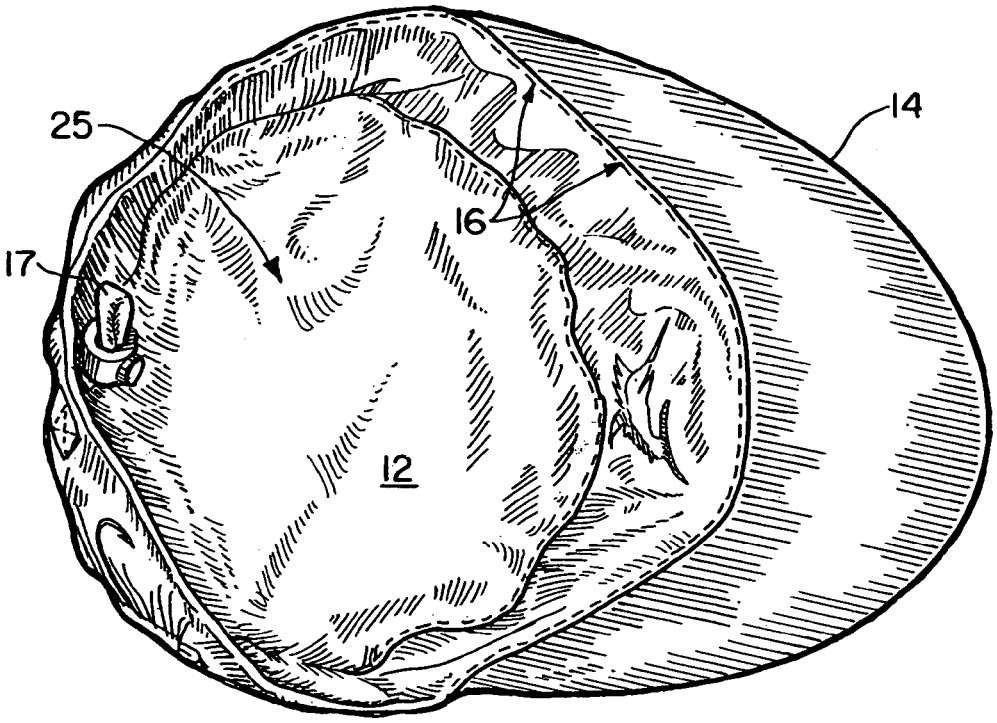
FIG. 3 is a perspective bottom view of the preferred embodiment of the apparatus of the present invention showing the first layer of the crown in the reversed, concave position.
Figure 4:
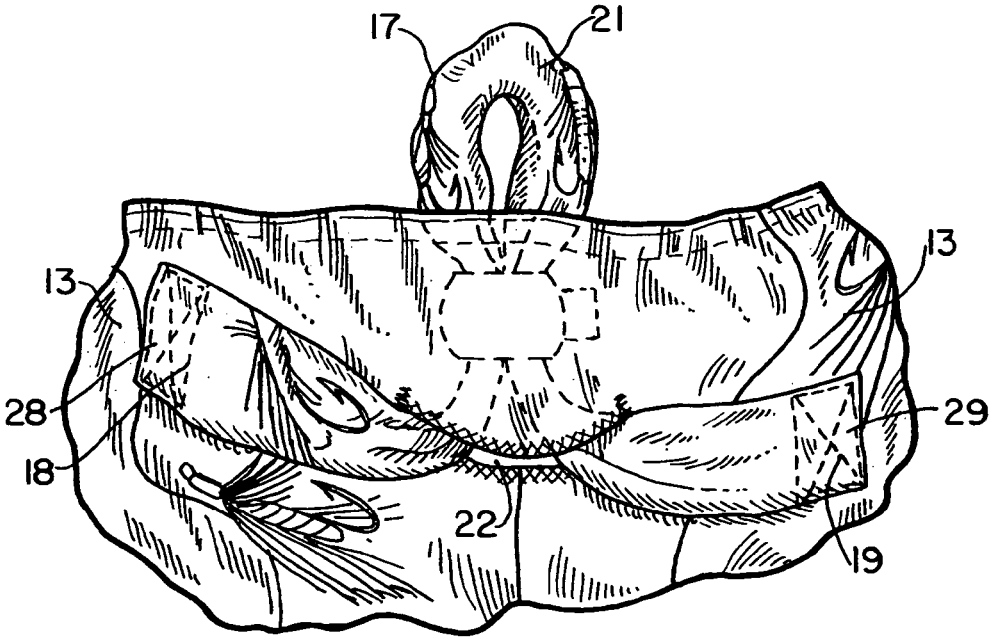
FIG. 4 is a fragmentary perspective view of the preferred embodiment of the apparatus of the present invention illustrating one view of the cord and cord opening.

The cap 10 of the present invention is reversible as shown in FIGS. 1 and 2, providing a first layer 12 that can be exposed during use (FIG. 1) and a second layer 13 that can be reversibly positioned to be worn externally as shown in FIG. 2. When the second layer 13 is exposed, the first layer 12 forms a concavity 25 that conforms to a wearer's head, the concavity 25 being seen in FIG. 3.

The reversible cap 10 of the present invention can be adjusted to fit the circumference of a wearer's head in either of the two positions shown in FIGS. 1 and 2. This adjustability is enabled by providing an adjustment cord 17 that is attached to the crown 11.

Figure 5:
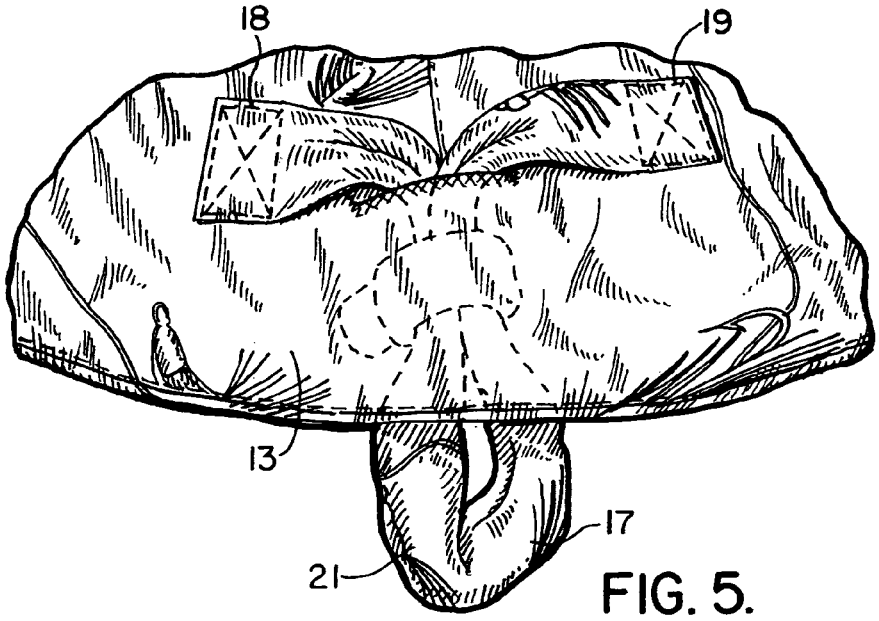
FIG. 5 is a fragmentary perspective view of the preferred embodiment of the apparatus of the present invention showing the adjustment cord, cord opening and stitches that hold the cord to the crown of the cap.
Figure 6:
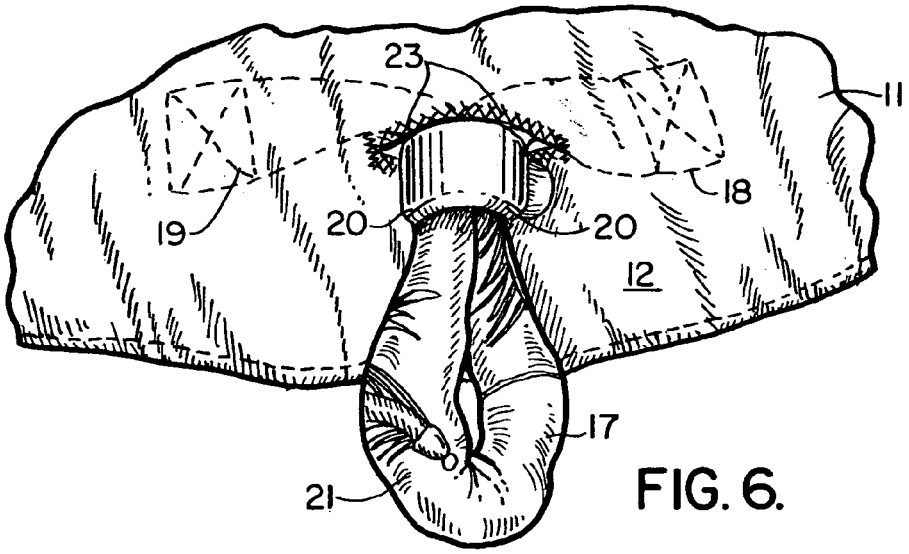
FIG. 6 is a fragmentary perspective view showing another view of the cord and its attachment to the cap at the second layer of the crown.

The cord attachment can be in the form of stitching such as is shown in FIGS. 5 and 6, the stitching being on generally opposite sides of cord opening 22 and designated as stitching 18 and stitching 19. Stitching 18 attaches one end of cord 17 to the one side of opening 22 as shown in FIG. 5. Stitching 19 attaches the other end of cord 17 to the layers 11, 12 at the other side of opening 22. The opening 22 enables the cord 17 and its end portions to be positioned in between the first and second layers 12, 13. Alternatively, the opening 22 can extend completely through the two layers 12, 13 so that the loop 21 formed at the center of cord 17 extends through opening 22 on the side of first layer 12 and the ends 28, 29 of cord 17 are stitched to the outer surface of the second layer 13.

The article 10 of the present invention will float, because the brim or bill 14 is of a material that will float (such as neoprene) and having a size and thickness of between about 2.5 and 3.5 millimeters. Thus, the brim 14 preferably supplies sufficiently to float the entire cap article 10, even when the crown is of a non-buoyant wettable or water absorbing material such as cotton.

A feature of the present invention is that the first and second layers can be of a very comfortable material such as 100% cotton, 50/50 cotton/polyester or other comfortable hat material. The brim can be made of a foam material that will float and is of a thickness, size and shape so that the buoyancy of the brim floats the entire cap 10 if it is inadvertently dropped in the water.

PARTS LIST

The following is a list of suitable parts and materials for the various elements of the preferred embodiment of the present invention.

| PART NO. | DESCRIPTION |
|---|---|
| 10 | reversible cap |
| 11 | crown |
| 12 | first layer |
| 13 | second layer |
| 14 | bill |
| 15 | stitching |
| 16 | stitching |
| 17 | adjustment cord |
| 18 | stitching |
| 19 | stitching |
| 20 | sleeve |
| 21 | loop |
| 22 | cord opening |
| 23 | stitching |
| 24 | stitching |
| 25 | concavity |
| 26 | first curved edge |
| 27 | second curved edge |
| 28 | cord end |
| 29 | cord end |

The foregoing embodiments are presented by way of example only; the scope of the present invention is to be limited only by the following claims.

What is claimed is:

1. A reversible cap, comprising:

a) a crown having a first layer, a second layer and a domed shape that enables a user to wear and conform the crown to the user's head, wherein either layer can be shaped into a concavity that abuts the user's head during use and wherein the other layer defines an outer exposed surface;

b) a bill of a floating foam material that has a first curved edge that is stitched to the crown in between the first and second layers, the bill having a second curved edge defining a front of the cap;

c) an adjustment cord that extends through an opening in at least one of the layers at a position opposite the bill, the cord having end portions that are attached to the crown at two positions generally on opposite sides of the cord opening;

d) a sleeve that adjustably, slidably attaches to the cord to form an adjustable loop with the cord;

e) wherein a user can adjust the fit of the hat to his or her head by moving the cord relative to the sleeve so that the loop is enlarged or reduced in size, the cap fits the wear when either the first or second layer is the outer exposed surface; and f) wherein the cord end portions are attached to the hat with stitching.

2. The reversible cap of claim 1 wherein the first and second layers are of a first material and the brim is of a different, second material.

3. The reversible cap of claim 1 wherein one of the first and second layers is of a first material, and the brim is of a different, second material.

4. The reversible cap of claim 1 wherein the cord opening is a slotted opening.

5. The reversible cap of claim 1 wherein the cord opening is bordered by stitching.

6. The reversible cap of claim 1 wherein the cord end portions are attached to the hat with stitching that joins the cord end portions to both the first and the second layer of the crown.

7. The reversible cap of claim 1 wherein the first and second layers are of a material that absorbs water and will not float once it is wetted and the bill is of a buoyant material.

8. The reversible cap of claim 7 wherein the bill is sufficiently buoyant to float the entire cap apparatus.

* * * * *